US008893341B2

(12) United States Patent
Park et al.

(10) Patent No.: US 8,893,341 B2
(45) Date of Patent: Nov. 25, 2014

(54) WASHING MACHINE AND METHOD OF CONTROLLING SPIN-DRYING THEREOF

(75) Inventors: Chan Woo Park, Anyang-si (KR); Sang Ho Seo, Suwon-si (KR); Seok In Hong, Suwon-si (KR); Jae Won Lee, Seoul (KR); Do Yeon Kim, Seoul (KR); Dong Woo Shin, Daejeon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1169 days.

(21) Appl. No.: 12/585,243

(22) Filed: Sep. 9, 2009

(65) Prior Publication Data

US 2010/0088829 A1 Apr. 15, 2010

(30) Foreign Application Priority Data

Oct. 9, 2008 (KR) ..... 10-2008-99271

(51) Int. Cl.

*D06F 37/24* (2006.01)
*D06F 35/00* (2006.01)
*D06F 37/20* (2006.01)

(52) U.S. Cl.

CPC ..... *D06F 37/203* (2013.01); *D06F 37/245* (2013.01)
USPC ..... 8/159; 68/12.06; 68/23.2

(58) Field of Classification Search

USPC ..... 8/158, 159; 68/12.06, 12.14, 23.1, 23.2, 68/23.3

See application file for complete search history.

(56) References Cited

U.S. PATENT DOCUMENTS

| | | | | |
|---|---|---|---|---|
| 2005/0108830 | A1* | 5/2005 | Park et al. | 8/158 |
| 2005/0283919 | A1* | 12/2005 | Kim | 8/158 |
| 2007/0124871 | A1* | 6/2007 | Kwon et al. | 8/159 |
| 2007/0266504 | A1* | 11/2007 | Xie et al. | 8/158 |
| 2008/0163435 | A1* | 7/2008 | Lee | 8/159 |
| 2009/0183318 | A1* | 7/2009 | Kim et al. | 8/159 |

FOREIGN PATENT DOCUMENTS

| | | |
|---|---|---|
| KR | 2001-0028452 | 4/2001 |
| KR | 10-2008-0040947 | 5/2008 |

* cited by examiner

*Primary Examiner* — Joseph L Perrin
(74) *Attorney, Agent, or Firm* — Staas & Halsey LLP

(57) ABSTRACT

Disclosed are a washing machine and a method of controlling spin-drying of the washing machine. The method changes the acceleration gradient of the drum passing a resonance point, i.e., the resonance point passing gradient of the drum, when the imbalance of the laundry due to the excessive vibration of the tub is sensed when passing a resonance point region (generally within 100 RPM, approximately 50~80 RPM, after the entry into the spin-drying cycle) in the spin-drying cycle. Thus the position of the balancer is changed according to the imbalance of the laundry.

19 Claims, 7 Drawing Sheets

WASHING MACHINE AND METHOD OF CONTROLLING SPIN-DRYING THEREOF

CROSS-REFERENCE TO RELATED APPLICATIONS

This application claims the benefit of Korean Patent Application No. 2008-0099271, filed on Oct. 9, 2008, in the Korean Intellectual Property Office, the disclosure of which is incorporated herein by reference.

BACKGROUND

1. Field

The present invention relates to a washing machine and a method of controlling spin-drying thereof, and more particularly to a washing machine, which minimizes spin-drying errors generated by the excessive vibration of a tub in a spin-drying cycle, and a method of controlling spin-drying of the washing machine.

2. Description of the Related Art

In general, a washing machine (for example, a full automatic washing machine) is an apparatus, which includes a tub to contain water (washing water or rinsing water), a drum rotatably installed in the tub to contain laundry to be washed (hereinafter, referred to as laundry), and a motor to generate a driving force to rotate the drum, and removes contaminants from the laundry through a surface active action of a water current and a detergent.

The washing machine performs washing of laundry through a series of cycles including a washing cycle, in which contaminants of laundry are removed by water containing a detergent (specifically, washing water). The cycles also include a rinsing cycle, in which bubbles or the remaining detergent of the laundry are removed by water not containing the detergent (specifically, rinsing water), and a spin-drying cycle, in which the laundry is spin-dried at a high speed. In the spin-drying cycle when the drum is rotated at a high speed when the laundry is not uniformly disposed in the drum but is eccentrically loaded on one side in the drum, eccentric force is applied to a rotary shaft of the drum. Thus the drum is eccentrically rotated and collides with the tub to generate heavy vibration and noise.

Therefore, a liquid balancer (hereinafter, referred to as a balancer) to maintain the rotating balance of the drum is installed at the circumference of the drum, and maintains the dynamic balance of the drum, which is in the unbalanced state due to the imbalance of the laundry in the spin-drying cycle, thus reducing the vibration of the tub.

However, the washing machine including the balancer has a difference in the position of the balancer to maintain the dynamic balance of the drum due the position or amount of the imbalance of the laundry. A resonance point, where the tub is excessively vibrated before the balancer does not reach a balancing position to remove the imbalance of the laundry, is generated in the initial stage of the spin-drying cycle (approximately, 50~80 RPM). The tub collides with an external case of the washing machine due to the excessive vibration of the tub and the overall washing machine is abnormally vibrated. Thereby, spin-drying errors are generated and thus the spin-drying cycle of the washing machine cannot be smoothly performed.

In order to solve the above problem, a checker switch to sense the excessive vibration of the tub generated by the imbalance of the laundry is conventionally installed between the case and the tub. When the tub strikes the checker switch due to the excessive vibration of the tub when the resonance point in the spin-drying cycle is passed, the spin-drying cycle is stopped, water is supplied to the drum to untangle the laundry, and then the spin-drying cycle is re-tried. However, this method increases a water consumption amount and lengthens a spin-drying time.

SUMMARY

Therefore, one aspect of the present exemplary embodiments is to provide a washing machine, which reduces the amplitude of the vibration of a tub by changing an acceleration gradient of a drum passing a resonance point when the imbalance of laundry is sensed by the excessive vibration of the tub when passing the resonance point in a spin-drying cycle. Thus, spin-drying errors are minimized. Also provided is a method of controlling spin-drying of the washing machine.

Additional aspects and/or advantages will be set forth in part in the description which follows and, in part, will be apparent from the description, or may be learned by practice of the invention.

The foregoing and/or other aspects of the present exemplary embodiments are achieved by providing a method of controlling spin-drying of a washing machine, which has a tub and a drum, including performing a spin-drying cycle by rotating the drum at a speed in a first mode; sensing whether or not the excessive vibration of the tub is generated during the spin-drying cycle; and continuously performing the spin-drying cycle by rotating the drum at a speed in a second mode, when the excessive vibration of the tub is sensed.

The excessive vibration includes sensing the excessive vibration within 100 RPM of a speed of the drum at a time of beginning the performing of the spin-drying cycle.

The speeds in the first and second modes may be acceleration gradients of the drum to pass a speed where the excessive vibration of the tub is generated.

The speed in the second mode may be an acceleration gradient of the drum to reduce an amplitude of the excessive vibration of the tub such that the speed in the second mode is not equal to the speed in the first mode.

The method may further include setting a number of times to sense the excessive vibration of the tub, and stopping the spin-drying cycle when the excessive vibration of the tub is sensed the set number of times.

The setting the number of sensing times includes setting different times according to a degree of imbalance of laundry in the drum generating the excessive vibration of the tub.

The foregoing and/or other aspects of the present exemplary embodiments may be achieved by providing a washing machine including a tub; a drum rotatably installed in the tub to accommodate laundry; a vibration sensing unit to sense an excessive vibration of the tub generated by an imbalance of the laundry; and a control unit to perform a spin-drying cycle by accelerating a speed of the drum to a speed in a first mode, and perform the spin-drying cycle by accelerating the speed of the drum at a speed in a second mode, when the excessive vibration of the tub is sensed during the spin-drying cycle.

The control unit may set the speed in the second mode to be different from the speed in the first mode.

The washing machine may further include a balancer to maintain a rotating balance of the drum, and the control unit may change an acceleration gradient of the drum to adjust the position of the balancer, when the excessive vibration of the tub is sensed.

The changing of the acceleration gradient of the drum reduces an amplitude of the vibration of the tub by adjusting the position of the balancer to remove an imbalance of the laundry.

A speed at which the excessive vibration is sensed may be a resonance point region generated before the balancer reaches a balancing position during the spin-drying cycle.

The control unit may set a number of times to sense the excessive vibration of the tub, and stop the spin-drying cycle when the excessive vibration of the tub is sensed the set number of times, and the control unit may set the number of sensing times differently according to the degree of the imbalance of the laundry.

The control unit may disentangle the laundry by supplying water to the drum after the stoppage of the spin-drying cycle, and then re-perform the spin-drying cycle.

The foregoing and/or other aspects of the present exemplary embodiments are also achieved by providing a method of controlling spin-drying of a washing machine, the washing machine including a tub and a drum, the method including rotating the drum at a speed in a first mode; sensing whether or not an imbalance of laundry is generated due to excessive vibration of the tub during the rotating of the drum at the speed in the first mode; and rotating the drum at a speed in a second mode to perform a spin-drying cycle, when the imbalance of the laundry is sensed.

BRIEF DESCRIPTION OF THE DRAWINGS

These and/or other aspects of the present exemplary embodiments will become apparent and more readily appreciated from the following description of the embodiments, taken in conjunction with the accompanying drawings in which.

DETAILED DESCRIPTION OF EMBODIMENTS

Figure 1:
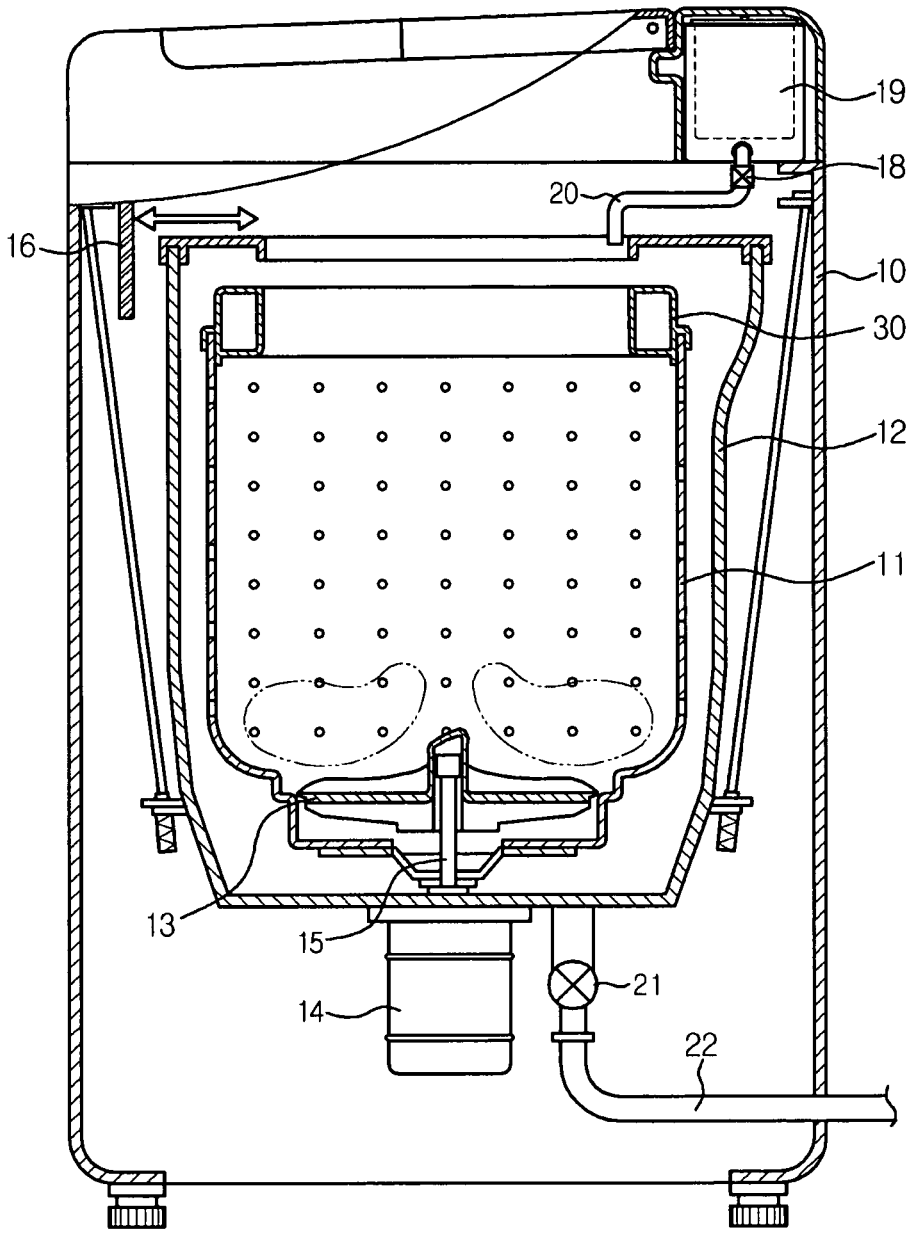
FIG. 1 is a longitudinal-sectional view illustrating the configuration of a washing machine in accordance with an exemplary embodiment.

Reference will now be made in detail to the exemplary embodiment, wherein like reference numerals refer to like elements throughout. The embodiment is described below by referring to the annexed drawings.

FIG. 1 is a longitudinal-sectional view illustrating the configuration of a washing machine in accordance with an exemplary embodiment.

As shown in FIG. 1, the washing machine in accordance with the exemplary embodiment includes a tub 11 installed in a case 10 forming the external appearance of the washing machine to contain water (washing water or rinsing water), and a drum 12 rotatably installed in the tub 11 to contain laundry.

A pulsator 13 to generate a water current for washing and rinsing cycles is installed at the bottom of the drum 12, and a motor 14 to provide a driving force to perform washing, rinsing, and spin-drying cycles is connected to a rotary shaft 15 at the outside of the lower portion of the tub 11.

A vibration sensing unit 16, which is struck by the tub 11 due to excessive vibration of the tub 11 to sense the imbalance of the laundry, is installed between the tub 11 and the case 10. The vibration sensing unit 16 uses a checker switch struck by the tub 11 before the tub 11 strikes the case 10 due to the excessive vibration of the tub 11, when the drum 12 is eccentrically rotated due to the imbalance of the laundry.

A water supply valve 18 and a detergent supply device 19 to respectively supply water and a detergent to the tub 11 are installed above the tub 11. The water supply valve 18 is installed on a water supply pipe 20 to supply water to the inside of the tub 11, and thus controls water supply. A drain valve 21 and a drain pipe 22 to drain the water in the tub 11 are installed under the tub 11.

A balancer 30 to maintain the rotating balance of the drum 12 is installed along the inner circumferential surface of the upper end of the drum 12.

Figure 2:
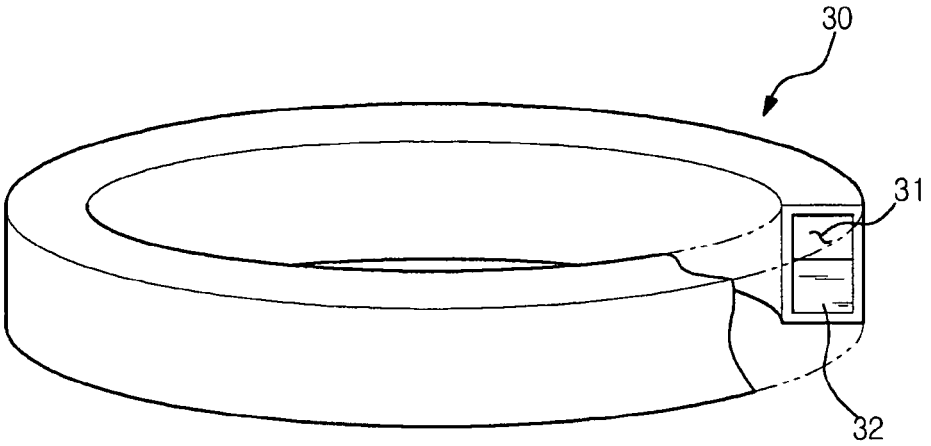
FIG. 2 is a perspective view illustrating a balancer of FIG. 1.

FIG. 2 is a perspective view illustrating the balancer of FIG. 1.

In FIG. 2, the balancer 30 forms a chamber 31 having a cylindrical loop shape, and the inside of the chamber 31 is filled with a liquid 32 to a designated height.

Figure 3:
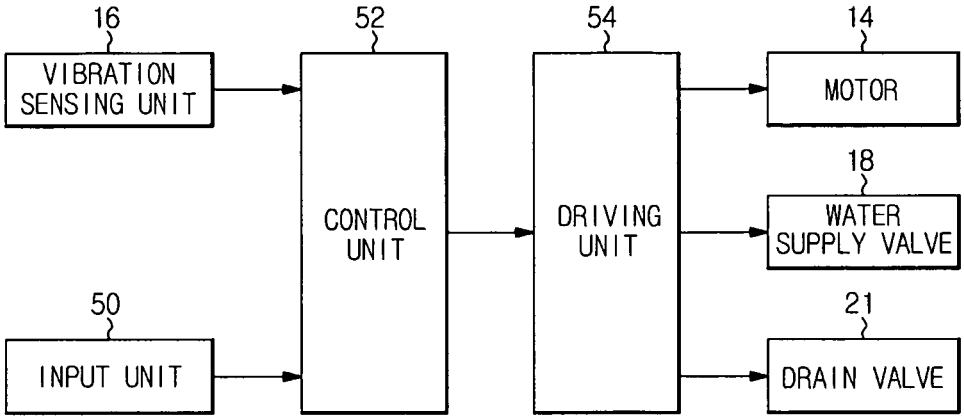
FIG. 3 is a block diagram illustrating a control system of the washing machine in accordance with the exemplary embodiment.

FIG. 3 is a block diagram illustrating a control system of the washing machine in accordance with the exemplary embodiment. The control system of the washing machine includes an input unit 50, a control unit 52, and a driving unit 54.

The input unit 50 inputs operation data including a washing course, a spin-drying RPM, whether or not a rinsing cycle is added, etc., which are selected by a user, to the control unit 52.

The control unit 52 is a microcomputer, which controls the overall operation of the washing machine, such as washing, rinsing, and spin-drying cycles, according to the operation data inputted from the input unit 50. Specifically, the control unit 52 changes an acceleration rate of the drum 12 passing a resonance point to minimize spin-drying errors due to the excessive vibration of the tub 11 generated by the imbalance of the laundry and the position difference of the balancer 30. The resonance point is within a resonance point region. The resonance point region is a range of RPM in which imbalance is more likely. The resonance point region is generally within 100 RPM, more specifically 50~80 RPM, after the entry into the spin-drying cycle.

Now, the operation of the control unit 52 changing the acceleration gradient of the drum 12 to pass the resonance point will be described with reference to FIG. 4.

Figure 4:
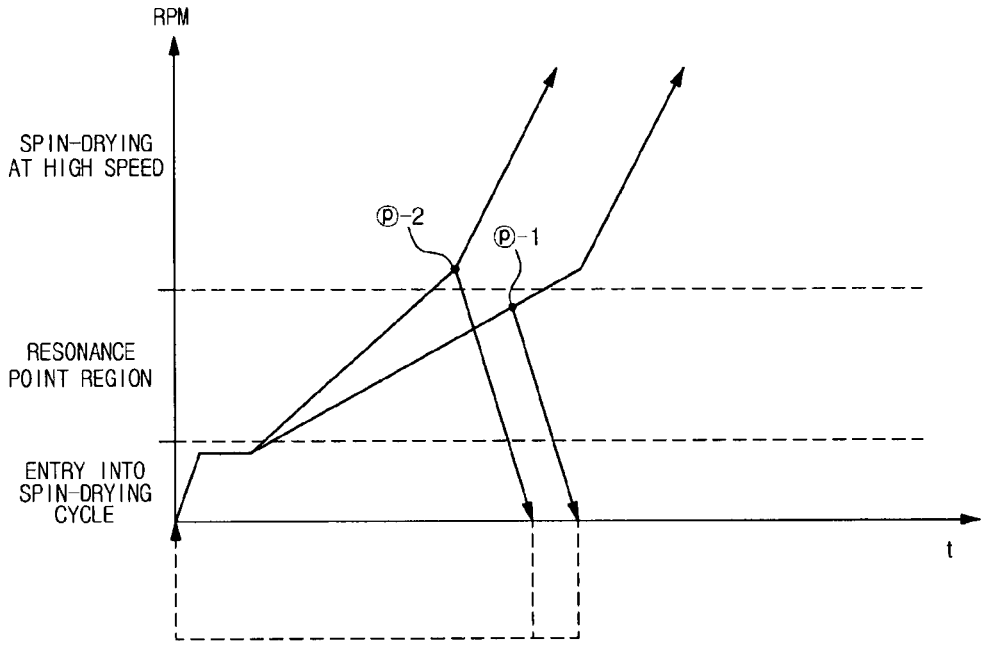
FIG. 4 is a graph illustrating a speed profile to pass a resonance point in a spin-drying cycle of the washing machine in accordance with the exemplary embodiment.

FIG. 4 is a graph illustrating a speed profile to pass a resonance point in a spin-drying cycle of the washing machine in accordance with the present exemplary embodiment, and more particularly illustrating a gradient accelerating the speed of the drum 12 according to the driving of the motor 14.

In FIG. 4, the control unit 52 accelerates the speed of the drum 12 to a resonance point passing gradient in a first mode, predetermined in the resonance point region (generated within 100 RPM, approximately 50~80 RPM, after the entry into the spin-drying cycle), where the tub 11 is excessively vibrated, at the initial stage of the spin-drying cycle, i.e., before the balancer 30 reaches a balancing position to remove the imbalance of the laundry. For example, the acceleration gradient (3 RPM/s) of the drum 12, is such that the drum 12 passes the resonance point region at the resonance point passing gradient in the first mode. When the vibration sensing unit 16 senses the imbalance (ⓟ-1) of the laundry due to the excessive vibration of the tub 11 when the drum 12 passes the resonance point at the resonance point passing gradient in the first mode, the control unit 52 stops the driving of the motor 14 to lower the RPM of the drum 12. The control unit 52 also changes (increases or decreases) the resonance point passing gradient, i.e., accelerates the speed of the drum 12 to a resonance point passing gradient (for example, 5 RPM/s) in a second mode, to search the position of the balancer 30 to reduce the amplitude of the excessive vibration of the tub 11 due to the imbalance of the laundry. When the speed of the drum 12 is accelerated to the resonance point passing gradient in the second mode, the speed of the position of the balancer 30 to maintain the rotating balance of the drum 12, which reacts with the imbalance of the laundry, is increased. The resultant force obtained by the imbalance of the laundry and the position of the balancer 30 is reduced and thus the amplitude of the vibration of the tub 11 when passing the resonance point is similarly reduced. Thereby, the excessive vibration of the tub 11 can be reduced. When the vibration sensing unit 16 does not sense again the imbalance (ⓟ-2) of the laundry due to the excessive vibration of the tub 11 when the drum 12 passes the resonance point at the resonance point passing gradient in the second mode, the control unit 52 performs spin-drying of the laundry at a high speed such that the spin-drying cycle can be performed without supplying water, and thus an unnecessary water consumption amount and a spin-drying time can be reduced.

On the other hand, when the vibration sensing unit 16 senses again the imbalance (ⓟ-2) of the laundry due to the excessive vibration of the tub 11 when the drum 12 passes the resonance point at the resonance point passing gradient in the second mode, the control unit 52 stops the driving of the motor 14 to lower the RPM of the drum 12, supplies water to the drum 12 to perform disentanglement of the laundry, and then performs the spin-drying cycle again.

The driving unit 54 drives the motor 14, the water supply valve 18, and the drain valve 21 according to a driving control signal of the control unit 52.

Figure 5:
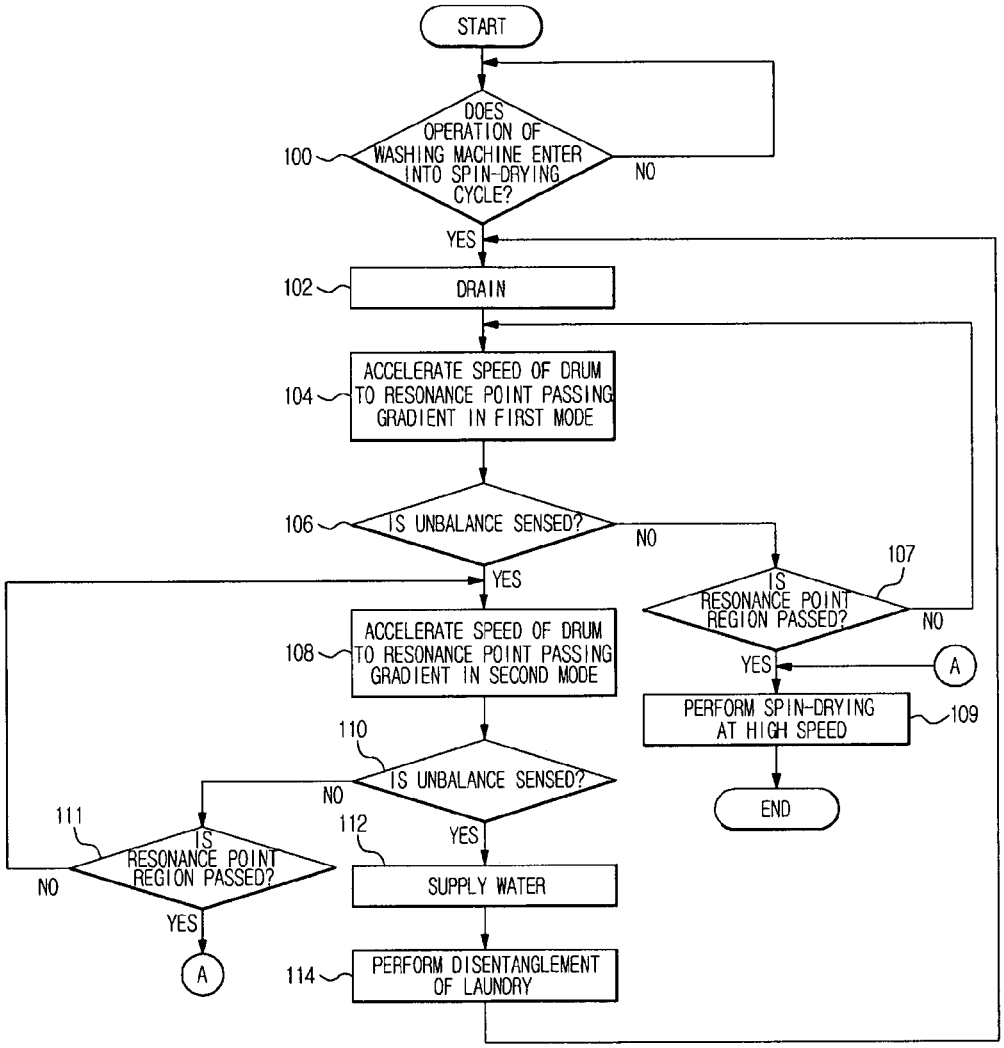
FIG. 5 is a flow chart illustrating a method of controlling spin-drying of the washing machine in accordance with the exemplary embodiment.

Point ⓟ-1 indicates sensing point imbalance is sensed with the resonance point region (106 in FIG. 5), and point ⓟ-2 indicates sensing point imbalance is sensed above the resonance point region (110 in FIG. 5). When the vibration sensing unit 16 senses the imbalance points ⓟ-1 and ⓟ-2, the control unit 52 also changes the resonance point passing gradient (for example, 3 RPM/s to 5 RPM/s) in order to search the position of the balancer 30 to reduce the amplitude of the excessive vibration of the tub 11 due to the imbalance of the laundry.

Hereinafter, the operation and functions of the above washing machine and a method of controlling spin-drying of the washing machine will be described.

FIG. 5 is a flow chart illustrating the method of controlling spin-drying of the washing machine in accordance with this exemplary embodiment. Through this method, spin-drying errors are minimized by reducing the amplitude of the vibration of the tub 11 by changing the acceleration gradient of the drum 12 passing the resonance point in the speed profile of the spin-drying cycle.

First, a user selects operation data, such as a washing course, a spin-drying RPM, or whether or not a rinsing cycle is added. This selection is made according to the kind of laundry under the condition that the laundry is put into the drum 12. The operation data selected by the user is input to the control unit 52 through the input unit 50.

Thus, the control unit 52 performs a series of cycles, including washing, rinsing, and spin-drying cycles, according to the operation data inputted from the input unit 50.

In order to control spin-drying of the washing machine in accordance with the embodiment, the control unit 52 determines whether or not the operation of the washing machine enters into the spin-drying cycle (100). When it is determined that the operation of the washing machine enters into the spin-drying cycle, the control unit 52 opens the drain valve 21 through the driving unit 54 such that water in the tub 11 is drained to the outside of the washing machine via the drain pipe 22 (102).

When the drain starts, the control unit 52 operates the motor 14 through the driving unit 54, and accelerates the speed of the drum 12 to a resonance point passing gradient in a first mode, predetermined in the resonance point region (generated within 100 RPM, approximately 50~80 RPM, after the entry into the spin-drying cycle), where the tub 11 is excessively vibrated, at the initial stage of the spin-drying cycle, i.e., before the balancer 30 reaches a balancing position to remove the imbalance of the laundry, i.e., the acceleration gradient (3 RPM/s) of the drum 12, thus allowing the drum 12 to pass the resonance point region (104).

The control unit 52 determines whether or not the vibration sensing unit 16 senses the imbalance (ⓟ-1) of the laundry due to the excessive vibration of the tub 11, when the drum 12 passes the resonance point (106). When it is determined that the vibration sensing unit 16 senses the imbalance (ⓟ-1) of the laundry, the control unit 52 stops the driving of the motor 14 to lower the RPM of the drum 12, and then changes (increases or decreases) the resonance point passing gradient, i.e., accelerates the speed of the drum 12 to a resonance point passing gradient (for example, 5 RPM/s) in a second mode, to search the position of the balancer 30 to reduce the amplitude of the excessive vibration of the tub 11 due to the imbalance of the laundry, thus allowing the drum 12 to pass the resonance point region (108).

Figure 6:
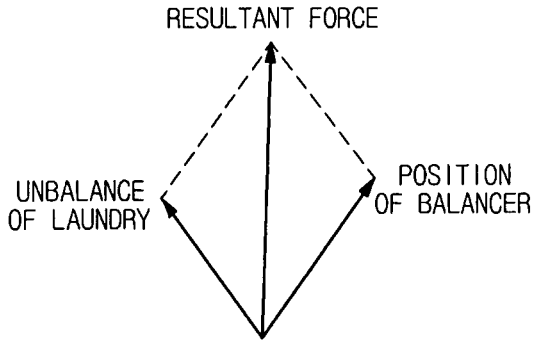
FIG. 6 is a graph illustrating the amplitude of the vibration of a tub passing the resonance point, when the resultant force obtained by the imbalance of laundry and the position of a balancer is large in the spin-drying cycle of the washing machine in accordance with the present exemplary embodiment.
Figure 6:
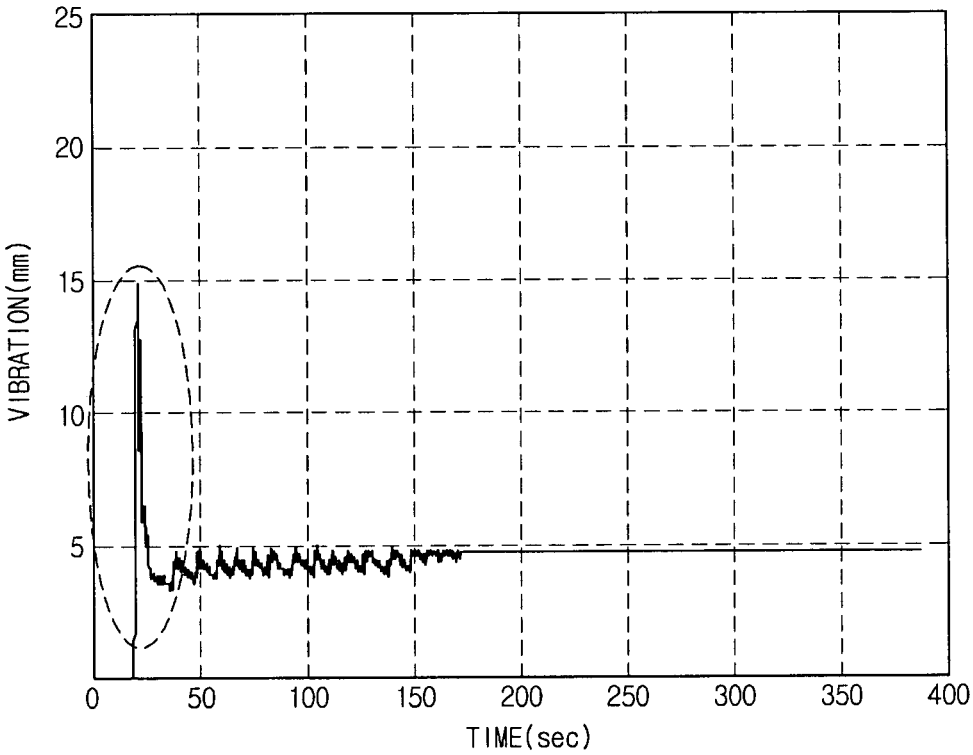
Figure 7:
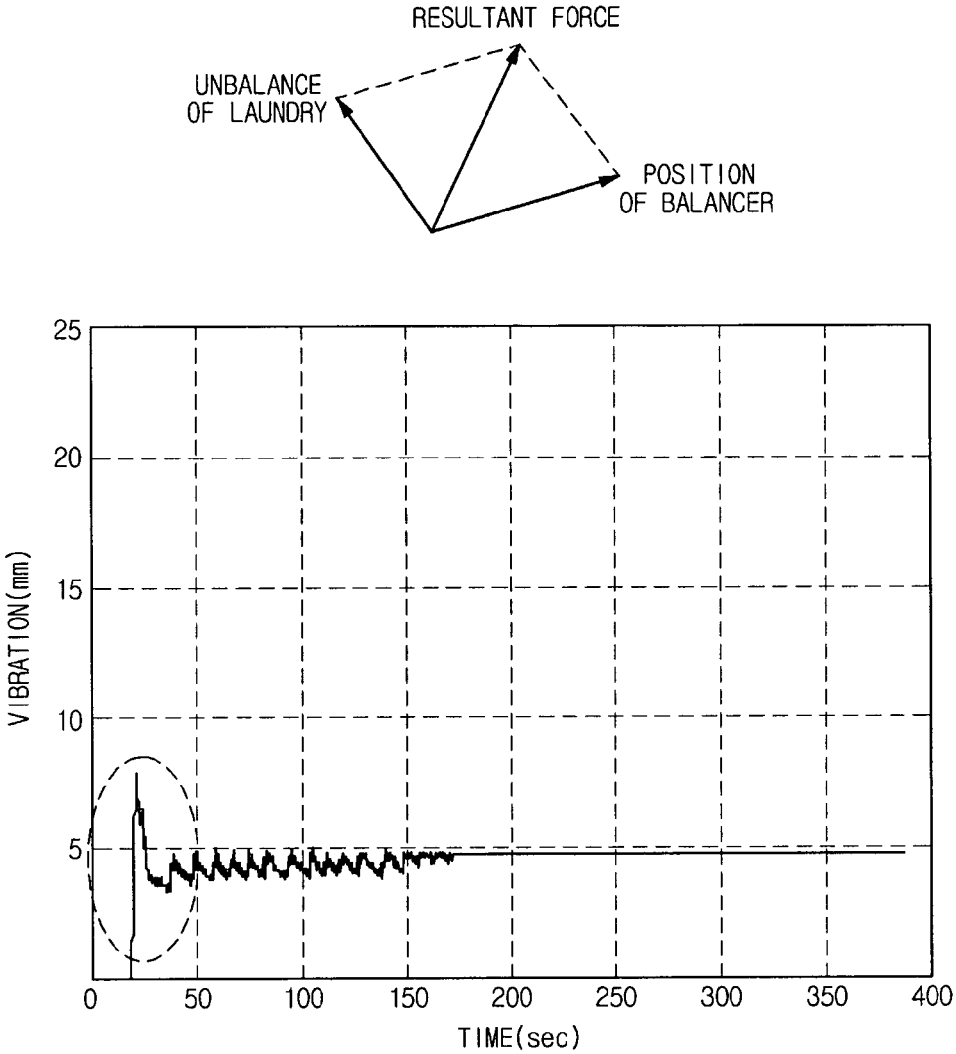
FIG. 7 is a graph illustrating the amplitude of the vibration of the tub passing the resonance point, in case that resultant force obtained by the imbalance of the laundry and the position of the balancer is small in the spin-drying cycle of the washing machine in accordance with the present exemplary embodiment.

When the speed of the drum 12 is accelerated to the resonance point passing gradient in the second mode, the speed of the position of the balancer 30 to maintain the rotating balance of the drum 12, which reacts with the imbalance of the laundry, is increased, and a resultant force obtained by the imbalance of the laundry and the position of the balancer 30 is reduced. This will be described with reference to FIGS. 6 and 7.

FIG. 6B is a graph illustrating the amplitude of the vibration of the tub passing the resonance point, when the resultant force obtained by the imbalance of laundry and the position of the balancer is large in the spin-drying cycle of the washing machine. FIG. 6A is force diagram illustrating the components of the resultant force. FIG. 7B is a graph illustrating the amplitude of the vibration of the tub passing the resonance point, when the resultant force obtained by the imbalance of the laundry and the position of the balancer is small in the spin-drying cycle of the washing machine in accordance with the present exemplary embodiment. FIG. 7A is a force diagram illustrating the components of the resultant force in FIG. 7A.

As shown in FIGS. 6A and 6B, when the position of the balancer 30 is close to the imbalance of the laundry, a large force corresponding to the resultant force is applied to the rotary shaft 15 of the drum 12, and the drum 12 is intensely vibrated right and left and collides with the tub 11, and thus the amplitude of the vibration of the tub 11 is increased as shown in the dotted line of the graph.

As shown in FIGS. 7A and 7B, when the position of the balancer 30 is distant from the imbalance of the laundry, a small force corresponding to the resultant force is applied to the rotary shaft 15 of the drum 12, and the drum 12 is weakly vibrated right and left and collides with the tub 11, and thus the amplitude of the vibration of the tub 11 is decreased as shown in the dotted line of the graph.

Thus, when the imbalance of the laundry due to the excessive vibration of the tub 11 is sensed when passing the resonance point, the acceleration gradient of the drum 12 passing the resonance point is changed and the position of the balancer 30 to reduce the amplitude of the excessive vibration of the tub 11 is searched.

Although this embodiment exemplarily describes a method of changing the resonant point passing gradient of the drum 12, in which the resonance point passing gradient in the second mode is set to a larger value than that of the resonance point passing gradient in the first mode, the exemplary embodiment is not limited to this method. The resonance point passing gradient in the second mode may be set to a smaller value than that of the resonance point passing gradient in the first mode. This is because when the excessive vibration of the tub 11 is generated when the drum 12 passes the resonance point at a resonance point passing gradient predetermined in the spin-drying cycle, the drum 12 can pass the excessive vibration section of the tub 11 by changing the resonance point passing gradient. Thus, the changed value of the resonance point passing gradient may be larger or smaller than the earlier value of the resonance point passing gradient.

Thereafter, the control unit 52 determines whether or not the vibration sensing unit 16 senses the imbalance (ⓟ-2) of the laundry due to the excessive vibration of the tub 11 when the drum 12 passes the resonance point at the resonance point passing gradient in the second mode (110). When it is determined that the vibration sensing unit 16 senses again the imbalance (ⓟ-2) of the laundry, the control unit 52 stops the driving of the motor 14 to lower the RPM of the drum 12, supplies water to the drum 12 through the water supply valve 18 (112), performs disentanglement of the laundry through turning the motor 14 to right and left (114), and then the method is fed back to operation 102 and again performs the spin-drying cycle.

On the other hand, as a result of the determination of operation 106, when it is determined that the vibration sensing unit 16 does not sense the imbalance (ⓟ-1) of the laundry due to the excessive vibration of the tub 11 when the drum 12 passes the resonance point at the resonance point passing gradient in the first mode, the control unit 52 determines whether or not the drum 12 passes the resonance point region (107), and when it is determined that the drum 12 does not pass the resonance point region, the method is fed back to operation 104 and then subsequent operations are performed.

As a result of the determination of operation 107, when it is determined that the drum 12 passes the resonance point region, the control unit 52 operates the motor 14 and thus rotates the drum 12 at a high speed to perform high-speed spin-drying (109). As described above, in this embodiment, although a spin-drying error occurs once, spin-drying is performed again without supplying water, and thus an unnecessary water consumption amount can be reduced and a spin-drying time can be shortened even when a spin-drying error occurs at the critical moment in a real spin-drying cycle.

As a result of the determination of operation 110, when it is determined that the vibration sensing unit 16 does not again sense the imbalance (ⓟ-2) of the laundry when the drum 12 passes the resonance point at the resonance point passing gradient in the second mode, the control unit 52 determines whether or not the drum 12 passes the resonance point region (111), and when it is determined that the drum 12 does not pass the resonance point region, the method is fed back to operation 108 and then subsequent operations are performed.

As a result of the determination of operation 111, when it is determined that the drum 12 passes the resonance point region, the control unit 52 performs operation 109 such that the drum 12 is rotated at a high speed by the driving of the motor 14 to perform high-speed spin-drying.

This embodiment exemplarily describes that the number of times to make a trial of passing the resonance point by changing the acceleration gradient of the drum 12 to pass the resonance point is set to one, when the vibration sensing unit 16 senses the imbalance of the laundry when passing the resonance point. However, the exemplary embodiment is not limited thereto. Instead, the number of times to make a trial of passing the resonance point (the number of times to sense the excessive vibration of the tub) may be set to different numbers according to the degree of the imbalance of the laundry.

As apparent from the above description, the method of controlling the spin-drying of the washing machine of this embodiment changes the acceleration gradient of the drum passing a resonance point, i.e., the resonance point passing gradient of the drum, when the imbalance of the laundry due to the excessive vibration of the tub is sensed when passing a resonance point region (generally within 100 RPM, approximately 50~80 RPM, after the entry into the spin-drying cycle) in the spin-drying cycle. Thus the position of the balancer is changed according to the imbalance of the laundry, thereby reducing the amplitude of the vibration of the tub and minimizing spin-drying errors. Further, the method allows the drum to pass the resonance point at the changed resonance point passing gradient, and thus causes the spin-drying cycle to be performed without supplying water, thereby reducing an unnecessary water consumption amount and shortening a spin-drying time.

Although an exemplary embodiment has been shown and described, it would be appreciated by those skilled in the art that changes may be made in this embodiment without departing from the principles and spirit of the invention, the scope of which is defined in the claims and their equivalents.

What is claimed is:

1. A method of controlling spin-drying of a washing machine, the washing machine comprising a tub and a drum, the method comprising:

performing a spin-drying cycle comprising rotating the drum by accelerating, at a first rate of acceleration, to a predetermined first speed in a first mode;

sensing whether an excessive vibration of the tub is generated while accelerating to the first speed;

when the excessive vibration of the tub is sensed in a resonance point region while accelerating to the first speed, reducing the speed of the drum and then rotating the drum by accelerating, at a second rate of acceleration, to a predetermined second speed in a second mode;

sensing whether the excessive vibration of the tub is generated in the second mode;

determining, by a controller, whether the drum passes the resonance point region in the second mode; and when it is determined that the resonance point region is passed, performing a spin-drying at a high speed, wherein the first rate of acceleration is different from the second rate of acceleration.

2. The method according to claim 1, wherein the sensing of the excessive vibration in the first mode comprises sensing the excessive vibration within 100 RPM of a speed of the drum at a time of beginning of the performing of the spin-drying cycle.

3. The method according to claim 1, wherein the drum is rotated to the predetermined second speed to pass a speed at which the excessive vibration of the tub is generated.

4. The method according to claim 1, wherein the drum is accelerated at the second rate of acceleration to reduce an amplitude of the excessive vibration of the tub.

5. The method according to claim 1, further comprising setting a number of times to sense the excessive vibration of the tub, and stopping the spin-drying cycle when the excessive vibration of the tub is sensed the set number of times.

6. The method according to claim 5, wherein the setting the number of sensing times comprises setting different times according to a degree of imbalance of laundry in the drum generating the excessive vibration of the tub.

7. The method according to claim 1, wherein the predetermined second speed is a speed which exceeds speeds corresponding to the resonance point region.

8. The method according to claim 1, wherein the sensing whether the excessive vibration of the tub is generated while accelerating to the first speed is performed using a vibration sensor which is disposed between the tub and a case of the washing machine.

9. The method according to claim 1, wherein the second rate of acceleration is greater than the first rate of acceleration.

10. A method of controlling spin-drying of a washing machine, the washing machine comprising a tub and a drum, and performs a washing cycle, a rinsing cycle and a spin-drying cycle, the method comprising:

determining whether the spin-drying cycle is a final spin-drying cycle;

draining water at an inside of the tub if it is determined as the final spin-drying cycle;

performing a spin-drying through a first mode of rotating the drum by accelerating the drum, at a first rate of acceleration, to a first speed that is set in advance;

sensing whether an excessive vibration of the tub is generated in the first mode;

when the excessive vibration of the tub is sensed in a resonance point region while accelerating to the first speed, reducing the speed of the drum and then switching to a second mode of rotating the drum by accelerating the drum, at a second rate of acceleration, to a second speed different from the first speed;

sensing whether the excessive vibration of the tub is generated in the second mode;

determining, by a controller, whether the drum passes the resonance point region in the second mode; and when it is determined that the resonance point region is passed, performing a spin-drying at a high speed, wherein, when a spin-drying error of the first mode occurs, additional water is not supplied to the drum between switching from the first mode to the second mode, wherein the first rate of acceleration is different from the second rate of acceleration.

11. The method of claim 10, further comprising, upon a spin-drying error while in the second mode, performing a spin-drying after additionally supplying water.

12. A washing machine comprising:

a tub;

a drum rotatably installed in the tub;

a vibration sensor to sense an excessive vibration of the tub generated by an imbalance in a first control mode and in a second control mode; and a control unit to control a spin-drying cycle in the first control mode by accelerating a speed of the drum, at a first rate of acceleration, to a first speed, and when the vibration sensor senses the excessive vibration of the tub in a resonance point region while accelerating to the first speed, the control unit controls the spin-drying cycle in the second control mode by reducing the speed of the drum and then accelerating the speed of the drum, at a second rate of acceleration, to a second speed, and the control unit determines whether the drum passes the resonance point region in the second mode, wherein, when the control unit determines that the resonance point region is passed, the control unit performs the spin-drying cycle at a higher speed than the first and second speed, wherein the first rate of acceleration is different from the second rate of acceleration.

13. The washing machine according to claim 12, wherein the control unit sets the speed in the second mode to be different from the speed in the first mode.

14. The washing machine according to claim 12, further comprising a balancer to maintain a rotating balance of the drum, wherein the control unit changes from the first control mode to the second control mode to adjust the position of the balancer, when the excessive vibration of the tub is sensed in the resonance point region while accelerating to the first speed.

15. The washing machine according to claim 14, wherein the changing from the first control mode to the second control mode reduces an amplitude of the vibration of the tub by adjusting the position of the balancer to remove an imbalance of the laundry.

16. The washing machine according to claim 14, wherein a speed at which the excessive vibration is sensed is in the resonance point region generated before the balancer reaches a balancing position during the spin-drying cycle.

17. The washing machine according to claim 12, wherein the control unit sets a number of times to sense the excessive vibration of the tub, and stops the spin-drying cycle, when the excessive vibration of the tub is sensed the set number of times.

18. The washing machine according to claim 17, wherein the control unit sets the number of sensing times differently according to a degree of the imbalance of the laundry.

19. The washing machine according to claim 17, wherein the control unit disentangles the laundry by supplying water to the drum after the stoppage of the spin-drying cycle, and then re-performs the spin-drying cycle.

* * * * *